United States Patent [19]

Zeroni et al.

[11] Patent Number: 5,040,737

[45] Date of Patent: Aug. 20, 1991

[54] CUTTING AND WINDING DEVICE FOR FILM STRIPS

[75] Inventors: Ludwig Zeroni, Ottobrunn; Bernd Scholtysik, Munich, both of Fed. Rep. of Germany

[73] Assignee: Agfa-Gevaert AG, Leverkusen, Fed. Rep. of Germany

[21] Appl. No.: 486,003

[22] Filed: Feb. 27, 1990

[30] Foreign Application Priority Data

Mar. 15, 1989 [DE] Fed. Rep. of Germany ..... 3908451

[51] Int. Cl.[5] ..... B65H 19/26; B65H 19/28; B65H 19/29

[52] U.S. Cl. ..... 242/56 A; 242/56.6

[58] Field of Search ..... 242/56 R, 56.2, 56.3, 242/56.4, 56.5, 56.6, 56.7, 56.8, 56.9, 58.1

[56] References Cited

U.S. PATENT DOCUMENTS

| | | | |
|---|---|---|---|
| 2,365,213 | 12/1944 | Packtor | 242/56.4 |
| 2,664,139 | 12/1953 | Speed et al. | 242/56.6 X |
| 2,698,359 | 12/1954 | Roberts | 242/56.4 X |
| 3,782,664 | 1/1974 | Alberto | 242/56 R |
| 3,977,285 | 8/1976 | Perztsch et al. | 83/501 |
| 4,026,491 | 5/1977 | Bostroem | 242/56.9 X |
| 4,081,151 | 3/1978 | Ender et al. | 242/68.5 |
| 4,116,398 | 9/1978 | Roberts | 242/56 R |
| 4,526,638 | 7/1985 | Clements | 242/56 R X |

FOREIGN PATENT DOCUMENTS

| | | |
|---|---|---|
| 0320751 | 6/1989 | European Pat. Off. . |
| 2346330 | 3/1975 | Fed. Rep. of Germany . |
| 3414636 | 11/1984 | Fed. Rep. of Germany . |
| 3418741 | 11/1985 | Fed. Rep. of Germany . |
| 3701716 | 8/1988 | Fed. Rep. of Germany . |

*Primary Examiner*—John M. Jillions
*Attorney, Agent, or Firm*—Connolly & Hutz

[57] ABSTRACT

A device is described for rapid reel change when winding film strips produced by guiding a continuous film web through a cutting device, wherein the strips are sucked by a sucking comb (3) provided with segments (5), a pivotable roller (6) is pressed against this sucking comb (3) which sucks the film strips, whereupon the sucking comb is pivoted onto a winding shaft (13) fitted with winding cores (14), which winding shaft (13) takes up the ends of the cut film strips, whereupon the complete tape winding (23) is prepared. The winding device (10) is then pivoted by 180° and a new winding shaft (13') already fully fitted is prepared for renewed winding.

12 Claims, 2 Drawing Sheets

CUTTING AND WINDING DEVICE FOR FILM STRIPS

BACKGROUND OF THE INVENTION

The invention relates to a cutting and winding device for film strips, in which the film strips arranged essentially in a horizontal row are guided to a reel or winding unit following on from a longitudinal cutting station to cut film strips from a web. It also relates to a process for changing the reel or winding core when winding the film strips.

In known plants for preparing film strips, a continous web of constant width is cut into individual film strips. This is carried out with the aid of a series of fixed separating knives arranged vertically to the web travel direction, which knives are at the same distance from one another and project into the web by means of their cutters directed against the movement of the web. The finished strips are then wound individually on a reel unit, onto reels or winding cores without flanges. The individual reel units can thus be arranged in a row behind one another or next to one another in the direction of travel of the film strips, or for a greater number of film strips to be wound, several rows of winding units can also be arranged above one another in stories.

When the reels or tape windings have reached their predetermined diameter, a change of reel is necessary. For this, the individual film strips are separated from their particular reels. The full reel is then taken off and an empty core is put on, whereupon the particular film strip is applied again for further winding. Considerable disadvantages of this type of reel change process are the resulting amount of waste and the considerable refitting and change-over time.

Processes or devices are known from numerous publications which should eliminate these disadvantages. Hence, a process for reel changing is described in German application 34 14 636 in which the amount of waste should be reduced when winding several rows of reel units arranged one behind another. A cutting and winding device is known from German application 34 18 741, in which the separated film strips are wound in each case onto cores connected fixedly to a winding shaft, and wherein four winding shafts are present in each case within a winding wheel which can be moved axially and can be guided to a detaching device and an attaching device, which devices simultaneously ensure the detachment from a winding shaft of winding cores and attachment of another shaft having new winding cores. A roller cutting and winding machine for film strips is known from German application 23 46 330, in which a separating station to separate neighbouring web strips in each case to separate winding axes is provided following on from a longitudinal cutting station for cutting web strips from a web, wherein aligning combs having radial aligning edges are arranged adjustably in longitudinal grooves of each winding axis and which position the winding cases. A corresponding device is known from German application 23 65 606, in which the films are guided on individual winding cores following on from a longitudinal cutting station for cutting film strips from a web, and wherein a drive roller resting on the periphery of the winding is assigned to each winding core.

Furthermore, winding devices for cut web strips are known, in which the strips are guided over a so-called spreading comb, that is to say pins which deflect the film strips in different directions, and wherein the strips are wound using a device according to the abovementioned German application 23 65 606. This requires, as mentioned above, extensive effort for changing the reel as soon as the full winding periphery is reached. If, for example a magnetic tape web 65 cm wide is cut longitudinally into strips 3.81 mm wide which are wound onto winding cores, about 170 tape windings must be adhered at the end and be removed from the winding axis, after which these winding axes are fitted anew with cores onto which the start of each film strip then has to be attached. This can involve a considerable re-fitting time which is approximately as long as the winding time. A further operation arises from the fact that the completed tape windings have to be provided optionally with intermediate layer films for transportation and have to be sent away stacked one on another in larger packages. In addition, the device described above requires a considerable amount of space. The object was therefore to find a winding device of the type mentioned above which has a compact structure has considerably reduced re-fitting times when windings are changed provides winding packages which are largely ready for dispatch.

SUMMARY OF THE INVENTION

In accordance with the invention, an apparatus and a method for cutting a film web into film strips and winding the strips onto winding cores is disclosed. The apparatus comprises a means for cutting the film web longitudinally into film strips, preferably a separating knife. The film strips so cut are also separated from one another a small distance traverse to the direction of travel of the web and film strips.

Downstream from the longitudinal cutting means is a sucking comb having vertical segments with lower tips of equal width, which width corresponds to the width of the film strips. The vertical segments are separated from one another by a distance corresponding to the distance of separation of the film strips. The number of vertical segments corresponds to the number of film strips. The sucking comb is pivotable laterally between two positions —a first position for the transverse cutting operation and a second position for the film strip loading operation.

On the opposite side of the film strips from the sucking comb there is a cylindrical pressure roller that is pivotable from a position not in contact with the lower surfaces of the film strips to a position in contact with the film strips. When in contact, the pressure roller applies a liquid, preferably water, to the underside of the film strips.

Farthest downstream in the winding operation there is a rotatable winding device with at least two arms. Each arm has at its end a driven axis or shaft onto which empty winding cores or reels are placed, the number and position of the winding cores corresponding to the number of and distance between the film strips. Optionally, dividers or circular film strips may be placed between the winding cores. During the winding operation one arm of the rotatable winding device is in position so that the individual film strips will each be wound around the outer circumferential surface of a winding core. The other arm of the rotatable winding device is not proximate to the path of travel of the film strips and the axis of this other arm can be loaded with empty winding cores.

Positioned between the sucking comb and the rotatable winding device is a means for cutting the film strips transverse to the direction of travel of the film strips, preferably a cutting wheel.

When the winding cores are completely wound with the film strips to a desired winding diameter (e.g. the desired length of film strips has been wound thereon), the transverse cutting operation can begin. The vertical segments of the sucking comb are subjected to low pressure so that the upper surfaces of the film strips are sucked into contact with the tips of the vertical segments. The travel of the tape is preferably halted at this instant and the film strips are cut transversely by the cutting wheel. Once the cut is made, residual tapes or tails of film strips trail from the wound winding cores. The starting tips of film strips for new windings are held under the suction by the vertical sections of the sucking comb. A liquid is applied to the lower surfaces of these tips of the film strips held by the sucking comb.

After the film strips are cut, the rotatable winding device is rotated to its other position so that the other arm loaded with empty winding cores is positioned near to the nominal path of travel of the film strips. Once the empty winding cores are in this position, the sucking comb pivots laterally to its second operating position adjacent to the empty winding cores. The wetted lower surfaces of the cut film strips contact the outer circumferential surfaces of the winding cores. The shaft on the arm holding the empty winding core rotates and the vertical segments of the sucking comb release the suction hold on the starting tips of the film strips, permitting the film strips to be wound around the winding cores. The sucking comb then returns to its first position. While the winding operation is underway, the already wound winding cores on the other arm of the rotatable winding device may be removed and packaged for sale.

A transverse cutting device preferably is provided, positioned upstream from the separating knife arrangement. The transverse cutting device has two spaced-apart fixed rails and one moveable rail between the fixed rails. The rails define two channels, one channel between the moveable rail and each fixed rail, into which two cutting wheels may enter to cut from the film web, transversely to the direction of travel of the film web, a strip of the film web. Preferably, the web is not moving when the web strip is cut. The web strip is then removed, leaving a gap in the film web. An adhesive strip is applied onto the film web on either side of this gap, with the adhesive attaching to the web on each side of the gap and with adhesive also on the strip in the gap. Preferably, the adhesive strip has bent lateral ends that do not have adhesive thereon. This web cutting operation is preferably carried out in intervals in a sequence so that the cuts are made to leave pre-determined desired lengths of film strips to be wound on the winding cores. Further details of the invention can be seen in the sub-claims, description and drawings.

BRIEF DESCRIPTION OF THE DRAWINGS

The invention is then described in more detail using the figures, in which.

DESCRIPTION OF THE PREFERRED EMDODIMENTS

1. CONSTRUCTION OF THE DEVICE ACCORDING TO THE INVENTION

Figure 1:
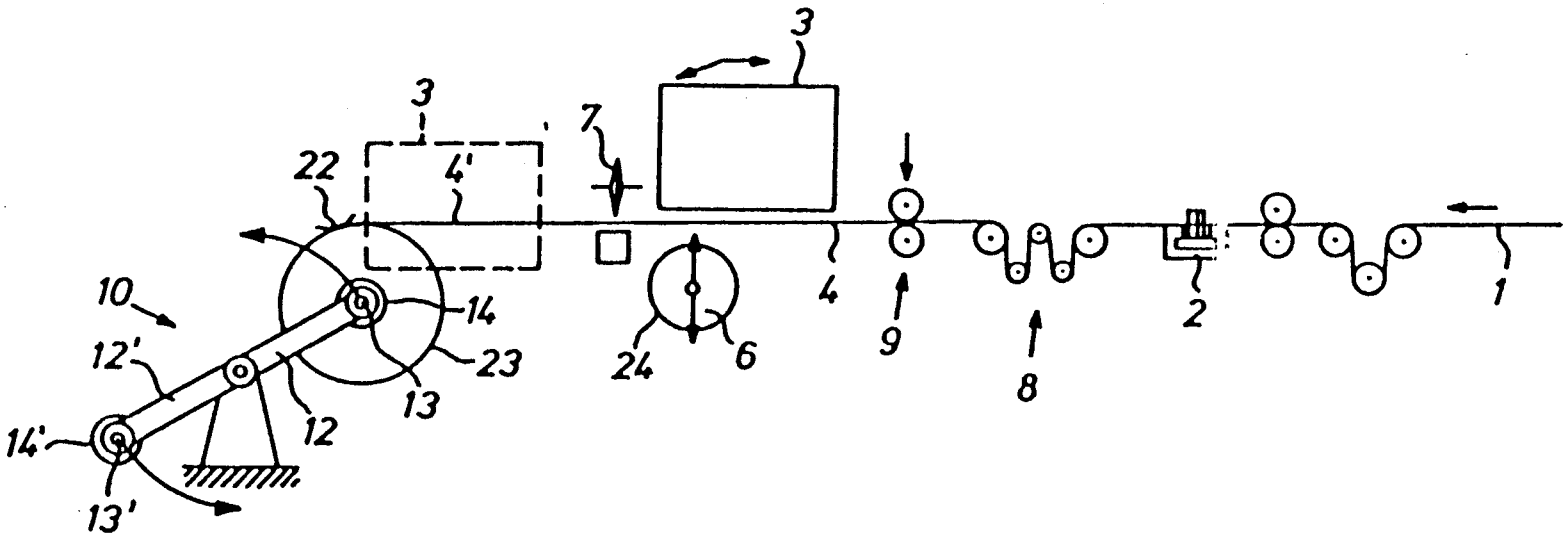
FIG. 1 shows a schematic side view of an embodiment of the invention.

FIG. 1 shows schematically the side view of a preferred embodiment of the device of the invention. The film web (1) coming from a casting or extrusion device (not shown) is guided in the direction of the arrow via a transverse cutting device (2), to be described further below, and then via a loop drawing device (8) to balance variations in web tension. The web is then cut longitudinally into narrow strips (4) by means of a separating knife arrangement (9) the axis of which is arranged vertically to the film web direction, or by means of a roller cutter. Arrangements of this type are known from numerous publications, for example from the applicant's U.S. Pat. No. 3,977,285 or German application 37 01 716, where arrangements for cutting magnetic tape webs into film strips are described in particular.

Figure 2:
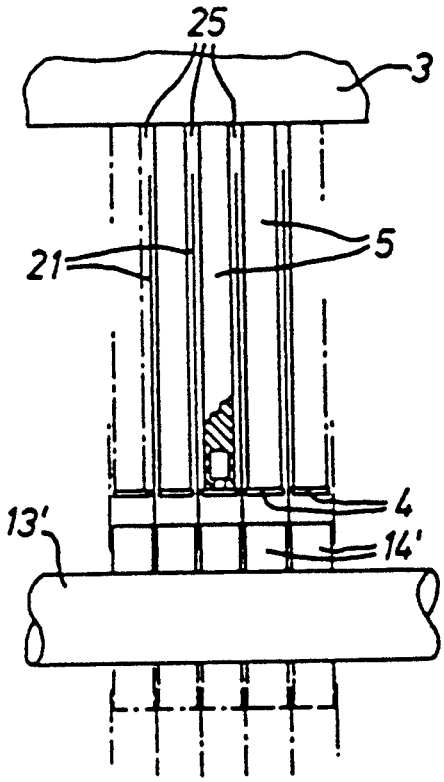
FIG. 2 shows a cross-section through a guiding sucking comb of the invention

The cut strips are passed between a pivotable pressure roller (6), the width of which is at least as large as the entire width of the film web, and a guiding sucking comb (3). The sucking comb comprises (FIG. 2) a number of vertically arranged segments (5), the number and width of these segments (5) correspond to the number and width of the film strips and they can be subjected to low pressure. The segments are arranged at a distance from one another. The sucking comb can be moved or pivoted laterally in the direction of travel of the film.

A cutting wheel (7) or a cutting knife moved transversely, which can be moved vertically to the film plane and transversely to the direction of travel, is located next to the sucking comb (3) in the direction of travel of the strips.

Winding the film strips (4) is effected by means of a rotatable winding device (10), comprising at least two arms (12, 12'), a drivable shaft (13, 13') being located at each free end of these arms (12, 12') as a winding axis. Flange reels or winding cores (14, 14') without flanges, for example, can be attached to the winding shafts. Winding cores without flanges are preferably attached for winding with the device of the invention, and particularly preferably stackable winding cores in accordance with U.S. Pat. No. 4,081,151, which are attached stacked one on another on a winding shaft, so that the windings or the winding surfaces are virtually next to one another without gaps. Thin circular films (21), consisting of plastic, cardboard or paper, can be placed between the winding cores as intermediate layers, the diameter of these circular films (21) is equal to, or preferably greater than, the maximum diameter of the web winding.

Figure 3:
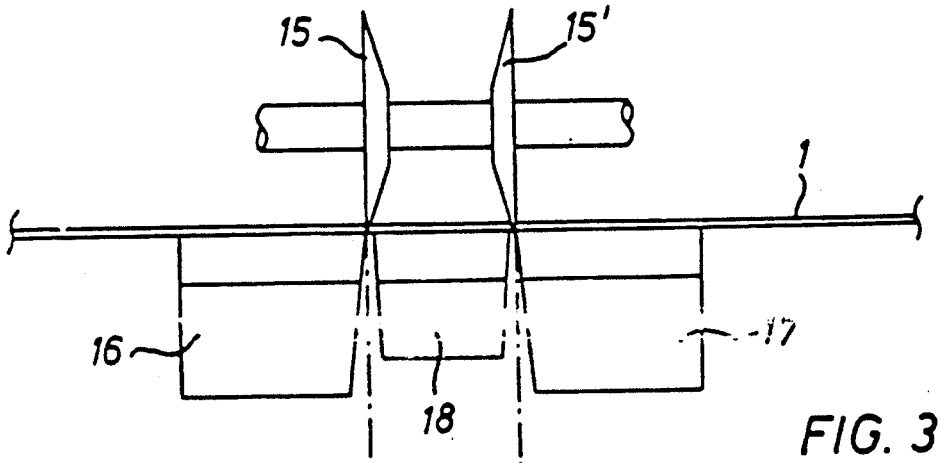
FIG. 3 shows a longitudinal section of a cutting table for transversely cutting the film web.
Figure 4:
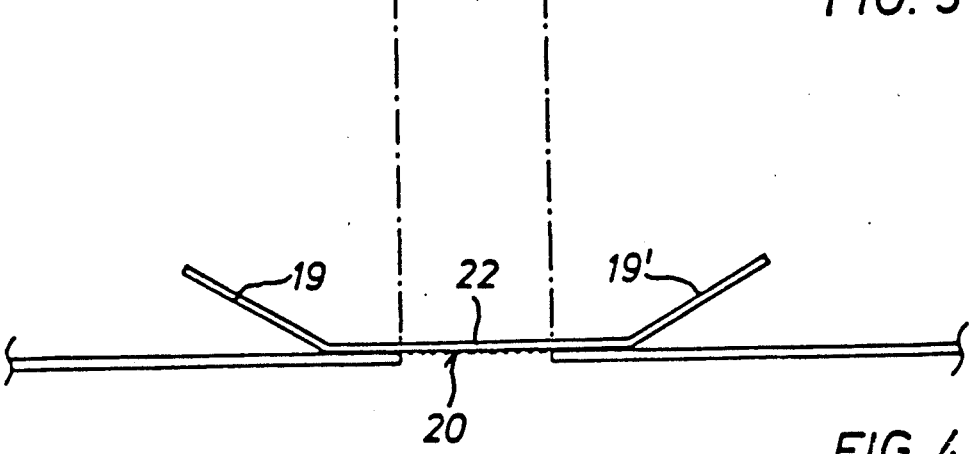
FIG. 4 shows a longitudinal section through an adhesive point of the web cut using the device according to FIG. 3.

The transverse cutting device (2) already mentioned serves to prepare a defined tape length, wherein a tape length and the one following on is provided with a certain adhesive point. In accordance with FIG. 3, this device comprises a three-part cutting table in a preferred embodiment. This has two fixed parallel support rails (16, 17) arranged transversely to the direction of travel of the film, and a narrow support rail (18), which can be moved vertically, arranged between them. Two small cutting wheels (15, 15') or cutting knife blades can enter between the two gaps between rails (16, 17) and the rail (18) which can be moved vertically, to cut the web (1) transversely. A tape provided with an adhesive surface is preferably used as adhesive tape (22) for binding the two separate web pieces, both lateral edges (19, 19') of this tape are turned away from the adhesive surface (20) bent at an obtuse angle and are free of adhesive (FIG. 4).

In a further embodiment, the cutting table may comprise only two support rails with one gap located between them, wherein one rail is displaced horizontally by the width of the rail (18) after the web is separated, and wherein the adhesive bond is then formed.

Likewise, the adhesive tape (22) can also only have one bent end free of adhesive.

2. Operation of the device of the invention for reel change

The full tape windings (23) each having an adhesive tape (22) on the outer periphery of the tape winding, and wound onto the winding cores (14), are situated on the winding shaft (13) which has just stopped. The roller (6) is then pivoted onto the sucking comb (3), the segments of which are subjected to low pressure so that they suck the film strips (4). The rotatable roller (6) is moistened on its cylindrical surface (24) with a liquid, for example water, to dampen the underside of the film web strips.

The cutting wheel (7) is then lowered onto the plane of the film and the film strips (4) are separated transversely to the direction of the web. A residual film (4') (e.g. a tail of the film strip) of 5 to 20 cm is thus left over from the adhesive point (22) to the end of the film, and there is also an excess piece of the film from the cutting point to the start of the sucking comb (3) approximately 5 to 10 cm.

If the fulm strips are separated, the winding device (10) rotates by 180° so that the unwound cores (14') already put onto the winding shaft (13') are now situated next to the sucking comb. The roller (6) is pivoted away from the sucking comb, whereupon the sucking comb with the attached strip ends (4) is pivoted to the winding shaft (13') with the cores (14') to a slight distance away from it, so that it arrives in the position shown by a dashed line in FIG. 1. The dampened undersides of the ends of the cut strips (4) now come to rest on the winding cores (14'). Likewise, the empty cores (14') can also be moistened beforehand by means of an appropriate device. To ease threading just described, the outer periphery of the intermediate layer films (21) provided between the winding cores, can enter the open gap (25) between the segments (5) of the guiding sucking comb (3). This can be made easier, for example by running the winding shaft (13') on for a short distance and hence the intermediate layers are tightened as a result of centrifugal force.

The winding shaft (13') is then driven slowly at first then more quickly and the winding process begins, while at the same time the low pressure is removed from the segments (5). The sucking comb is pivoted away either suddenly or gradually, increasing with the winding diameter of the newly formed tape winding, and reaches its original position again (FIG. 1). During this winding process, which can take place at high speed, approximately 1,000 m/minute, all prepared tape windings (23) can be removed as one complete unit on the arm (12) of the device (10), and can be packed ready for dispatch, for example in a packing unit in accordance with GB 1 576 973 or in accordance with the applicant's EP 0 320 751. The shaft (13) is then re-fitted with empty winding cores.

A defined tape length of the film web is advantageously prepared by the transverse cutting device (2) already described. This occurs by transversely cutting the film web when it stops at defined distances, on this device using small cutting wheels (15, 15'), then displacing the support rail downwards, and removing the narrow piece of tape located on it in any manner. An adhesive tape (22) is then applied and the two tape ends are joined together by means of the adhesive surface (20). There is a short distance between the tape ends which can be a few millimeters to a few centimeters. If this adhesive point reaches the tape winding on the winding shaft (13 or 13'), the tape end adheres and the winding process is completed. The process can then be continued in a new cycle as described above.

It can be seen from the description above that the re-fitting times for changing the winding can be considerably shortened using the device of the invention, and that at the same time a complete package ready to dispatch can be removed every time. It is possible in this manner, for example in the manufacture of magnetic recording media by pouring a magnetic dispersion on a non-magnetic substrate, to separate them into longitudinal strips and to wind them online, after drying and calendering the cast film web, particularly as the compact construction of the device of the invention can deal with this operation.

The processer can then easily open the adhesive points of each magnetic tape winding, the so-called pancake, at the projecting end of the adhesive point, for example for loading or winding magnetic tape into cassettes, remove the short film residues (4') and then feed the magnetic tape strips into loaders or winders in accordance with the known state of the art.

We claim:

1. An apparatus for cutting a film web into film strips and winding the strips onto winding cores, comprising:

a means for cutting the moving film web having an upper and lower surface longitudinally into moving film strips, each strip having an upper and lower surface and a width, with the strips moving in a defined travel path;

a means for separating the strips a small distance transverse to the direction of travel of the web and film strips;

a sucking comb having vertical segments with lower tips of a width corresponding to that of the film strips, with the vertical segments being separated from one another by a distance corresponding to the distance of separation of the film strips, and with the number of vertical segments corresponding to the number of film strips, the sucking comb being pivotable between two positions, a first position during a transverse cutting operation and a second position during a film strip threading operation;

a cylindrical pressure roller, with a circumferential roller surface, proximate to the lower surface of the film strips and pivotable from a position not in contact with the lower surfaces of the film strips to a position in contact with the film strips;

a rotatable winding device with at least two arms, each arm having at its end a driven axis onto which winding cores are placed, the film strips being windable onto outer circumferential surfaces of the winding cores and with the number of winding cores corresponding to the number of film strips, with one arm of the rotatable winding device positioned so that the film strips are wound around the winding cores and the other arm of the rotatable winding device is positioned away from the travel path of the moving film strips; and a means for cutting the film strips transversely to the direction of travel of the film strips positioned between the sucking comb and the rotatable winding device, which cutting occurs during the transverse cutting operation when the winding cores are completely wound with the film strips, during which, movement of the web and film strips is halted and the vertical segments of the sucking comb are subjected to low pressure to suck the upper surfaces of the film strips into contact with the tips of the vertical segments and the roller surface of the cylindrical roller contacts the lower surfaces of the film strips to wet the lower surfaces of the film strips with a liquid and the transverse cutting means cuts the film strips, leaving film strip tails trailing from the wound winding cores and film strip starting tips with wetted lower surfaces that are sucked by the vertical sections of the sucking comb, so that the film strip tips will be threaded onto the empty winding cores of the rotatable winding device when the arms of said winding device are rotated to place the empty winding cores near the path of travel of the film strips and the sucking comb is moved to its second position where the wetted surfaces of the film strips will contact the outer circumferential surfaces of the winding cores to begin winding film strips onto the winding cores.

2. The apparatus for cutting a film web into film strips and winding the strips onto winding cores of claim 1, further comprising:

a means for cutting transversely to the direction of travel of the film web a strip of the film web leaving two ends of web with a web strip there between;

a means for removing the cut strip of the film web; and a means for attaching an adhesive strip to the upper surface of the web connecting the two web ends but leaving a gap therebetween corresponding to the width of the cut web strip.

3. The apparatus for cutting a film web into film strips and winding the strips onto winding cores of claim 2, wherein the means for cutting a strip from the film web has two spaced-apart fixed rails, the rails defining two channels into which two cutting wheels enter to cut from the film web transversely to the direction of travel of the film web a strip of film web.

4. The apparatus for cutting a film web into film strips and winding the strips onto winding cores of claim 2, wherein the means for cutting a strip from the film web has two spaced-apart support rails separated by a gap, and two cutting wheels to cut from the film web transversely to the direction of travel of the film web a strip of film web having a width corresponding about to the gap between the support rails.

5. The apparatus for cutting a film web into film strips and winding the strips onto winding cores of claim 2, wherein the means for cutting a strip from the film web has two spaced-apart fixed rails and one moveable rail, the moveable rail being between the fixed rails, the rails defining two channels into which two cutting wheels enter to cut from the film web transversely to the direction of travel of the film web a strip of film web.

6. The apparatus for cutting a film web into film strips and winding the strips onto winding cores of claim 2, wherein the adhesive strip applied has a central portion with adhesive and at least one lateral end that is bent and free of adhesive.

7. A process for cutting a film web into film strips and winding the strips onto winding cores, comprising the steps of:

(a) cutting the moving film web, having an upper and lower surface, longitudinally into film strips, having upper and lower surface, moving along a travel path;

(b) separating the strips a small distance transverse to the direction of travel of the web and film strips;

(c) winding the film strips onto outer circumferential surfaces of winding cores positioned on a drivable axle on an arm of a rotatable winding device with at least two arms having drivable axles;

(d) halting movement of the film web and film strips during a transverse cutting operation that begins after the winding cores are completely wound with the film strips;

(e) sucking the upper surfaces of the film strips into contact with vertical segments of a sucking comb with the comb being in a first position during the transverse cutting operation;

(f) cutting the film strips transversely to the direction of travel of the film strips with a means for cutting positioned between the sucking comb and the rotatable winding device;

(g) applying a liquid to the lower surfaces of the film strips with a cylindrical pressure roller positioned so that during the time of liquid application the upper surface of the film strips are held by the vertical segments of the sucking comb and the lower surfaces of the film strips are in contact with the cylindrical roller;

(h) rotating the arms of the rotatable winding device so that winding cores with outer circumferential surfaces not yet wrapped with film strips are in a position proximate to the path of travel of the film strips when the winding operation is underway;

(i) pivoting the sucking comb into a second position for the threading of the winding cores with film strips;

(j) threading the wetted lower surfaces of the film strips onto the outer circumferential surfaces of the winding cores by contacting the wetted lower surfaces of the film strips with the circumferential winding core surface and releasing the film strips from contact with the vertical segments of the sucking comb;

(k) winding the film strips onto the winding cores; and (l) pivoting the sucking comb into its first position.

8. The process for cutting a film web into film strips and winding the strips onto winding cores of claim 7, further comprising:

(m) cutting from the film web transversely to the direction of travel of the web a strip of web, leaving two ends of web with a cut web strip therebetween;

(n) removing the cut web strip; and (o) attaching an adhesive strip to the upper surface of the web, connecting the two ends of web but leaving a gap therebetween corresponding to the width of the cut web strip.

9. The process for cutting a film web into film strips and winding the strips onto winding cores of claim 8, wherein the transverse cutting of the film web occurs at intervals such that the length of film strips and web between the transverse web cutting means and the rotatable winding device corresponds to the length of the film strips to be wound on the winding cores.

10. The process for cutting a film web into film strips and winding the strips onto winding cores of claim 8, wherein the adhesive strip applied has a central portion with adhesive and at least one lateral end that is bent and free of adhesive.

11. The process for cutting a film web into film strips and winding the strips onto winding cores of claim 8, wherein the adhesive strip has a central portion with adhesive and is positioned with a part of the central portion not attached to the two ends of the cut web so that the central portion will adhere to an outer periphery of the film strips wound on the winding cores to secure the film strips when the winding cores are completely wound with the film strips.

12. The process for cutting a film web into film strips and winding the strips onto winding cores of claim 7, further comprising the steps of:

(m) removing the film strip wound winding cores from the arm of the rotatable winding device;

(n) loading empty winding cores onto the arm of the rotatable winding device.

* * * * *